US007887156B2

(12) United States Patent
Middleton et al.

(10) Patent No.: US 7,887,156 B2
(45) Date of Patent: Feb. 15, 2011

(54) INTEGRAL PRINTHEAD ASSEMBLY

(75) Inventors: James N. Middleton, Brentwood, CA (US); David Albertalli, Santa Clara, CA (US); Paul A. Parks, Austin, TX (US); Daniel Sramek, San Jose, CA (US)

(73) Assignee: Ulvac, Inc., Kanagawa (JP)

( * ) Notice: Subject to any disclaimer, the term of this patent is extended or adjusted under 35 U.S.C. 154(b) by 650 days.

(21) Appl. No.: 11/912,217

(22) PCT Filed: Apr. 25, 2006

(86) PCT No.: PCT/US2006/015614

§ 371 (c)(1),
(2), (4) Date: Oct. 22, 2007

(87) PCT Pub. No.: WO2006/116393

PCT Pub. Date: Nov. 2, 2006

(65) Prior Publication Data

US 2008/0192077 A1 Aug. 14, 2008

Related U.S. Application Data

(60) Provisional application No. 60/674,584, filed on Apr. 25, 2005, provisional application No. 60/674,585, filed on Apr. 25, 2005, provisional application No. 60/674,588, filed on Apr. 25, 2005, provisional application No. 60/674,589, filed on Apr. 25, 2005, provisional application No. 60/674,590, filed on Apr. 25, 2005, provisional application No. 60/674,591, filed on Apr. 25, 2005, provisional application No. 60/674,592, filed on Apr. 25, 2005.

(51) Int. Cl.
*B41J 2/015* (2006.01)

(52) U.S. Cl. ..... 347/20; 347/40; 347/37; 347/5

(58) Field of Classification Search ..... 347/21, 347/36, 65, 84, 19, 37, 2, 4, 5, 20, 40
See application file for complete search history.

(56) References Cited

U.S. PATENT DOCUMENTS

| | | | | |
|---|---|---|---|---|
| 4,814,795 | A | 3/1989 | Kuester et al. | |
| 6,019,466 | A | 2/2000 | Hermanson | |
| 6,313,861 | B2 | 11/2001 | Schartner | |
| 6,431,674 | B2 * | 8/2002 | Suzuki et al. | 347/10 |
| 6,450,612 | B2 | 9/2002 | Igarashi et al. | |
| 6,565,177 | B1 | 5/2003 | Corrigan | |
| 6,672,696 | B2 | 1/2004 | Fairchild et al. | |
| 6,712,444 | B2 * | 3/2004 | Abe et al. | 347/19 |
| 6,796,630 | B2 * | 9/2004 | Ison et al. | 347/18 |
| 6,863,364 | B2 | 3/2005 | Russell et al. | |
| 7,008,482 | B2 * | 3/2006 | Goto | 118/323 |
| 7,036,917 | B2 | 5/2006 | Muller-Chorus et al. | |

(Continued)

OTHER PUBLICATIONS

European Search Report dated May 7, 2010.

*Primary Examiner*—Juanita D Stephens
(74) *Attorney, Agent, or Firm*—Harness, Dickey & Pierce, PLC

(57) ABSTRACT

The present invention relates to an integral printhead assembly for use in association with an industrial printing apparatus. The integral printhead assembly is a self-contained unit which can be quickly removed and replaced with another assembly with minimum downtime to the printing apparatus.

24 Claims, 8 Drawing Sheets

U.S. PATENT DOCUMENTS

| | | | | |
|---|---|---|---|---|
| 7,214,347 | B1 * | 5/2007 | Burgarella et al. | 422/100 |
| 7,217,438 | B2 * | 5/2007 | Newsome et al. | 427/8 |
| 7,222,934 | B2 * | 5/2007 | Williams | 347/20 |
| 7,278,847 | B2 * | 10/2007 | Silverbrook | 425/375 |
| 7,387,366 | B2 * | 6/2008 | Ingham et al. | 347/55 |
| 2004/0250760 | A1 | 12/2004 | Goto | |
| 2006/0132529 | A1 * | 6/2006 | Verhoest et al. | 347/19 |
| 2008/0170089 | A1 * | 7/2008 | Albertalli et al. | 347/8 |
| 2008/0186353 | A1 * | 8/2008 | Parks et al. | 347/37 |
| 2008/0192089 | A1 * | 8/2008 | Albertalli et al. | 347/50 |

* cited by examiner

INTEGRAL PRINTHEAD ASSEMBLY

CROSS-REFERENCE TO RELATED APPLICATIONS

This application is a National Stage of International Application No. PCT/US2006/015614, filed Apr. 25, 2006, and claims the benefit of U.S. Provisional Application Nos. 60/674,584, 60/674,585, 60/674,588, 60/674,589, 60/674,590, 60/674,591, and 60/674,592, all filed on Apr. 25, 2005. The disclosures of the above applications are incorporated herein by reference.

FIELD

The present teachings relate to an integral printhead assembly for use in an individual printing apparatus

BACKGROUND

In piezoelectric microdeposition (PMD) apparatuses, machine down time resulting from switching out ineffective printheads should be minimized. Generally, when a printhead fails, the entire PMD printing operation has to be stopped so that the printhead can be changed. Once changed, the printhead has to be calibrated and tested on-line to ensure it is functional prior to bringing the PMD back up for production. However, calibration and testing typically takes more time than is desirable, further contributing to machine downtime.

SUMMARY OF THE INVENTION

An integral printhead assembly may be a self-contained printer module requiring an Ethernet, or any other data and control protocol, connection, power, encoder signals from both the main printing X-Y stage and the drop analysis X-Y stage for firing, printing fluid material, and vacuum/pressure. Each integral printhead assembly may be arranged in an array, and as the need for additional printheads arises with increased throughput or larger substrate sizes, more integral printhead assemblies can be added without redesigning the electrical or software architecture. Each integral printhead assembly has sufficient computing power to calculate firing positions based on drop velocity and travel speed as the unit is printing, or in real time. While a central computer could perform this function and dispatch the data to the printheads, as the need for 20 to 40 printheads becomes common for larger substrate sizes, such as the manufacture of large flat panel displays by way of non-limiting example, the transfer rates required for a central computer may become impractical.

By processing the data in each printhead assembly, the integral printhead assembly can account for both linear and non-linear distortion of the substrate, and to limit production delays the integral printhead assembly can be tested and calibrated off-line using a fixture that can interface to the PC inside the integral printhead assembly and also supply the fluid and pressure controls. The fixture would have an optical system capable of measuring the ejected droplets from the printhead and measuring the velocity, directionality, and volume. Based on a compensation algorithm, new drive waveforms would be downloaded to the integral printhead assembly until the required performance for these parameters is achieved. Once achieved, the drive waveforms are stored in a non-volatile memory of a databoard assembly located within the integral printhead assembly along with its serial number, date of testing, pressure and vacuum levels at adjustment, and any other process information that is desired. The integral printhead assembly would be kept in a ready state for quick replacement of a failed printhead in the production array of integral printheads being used by the PMD manufacturing tool. This fixture may include one drop check unit that can service multiple integral printhead assemblies that are kept in standby ready for transfer.

DETAILED DESCRIPTION

Figure 1:
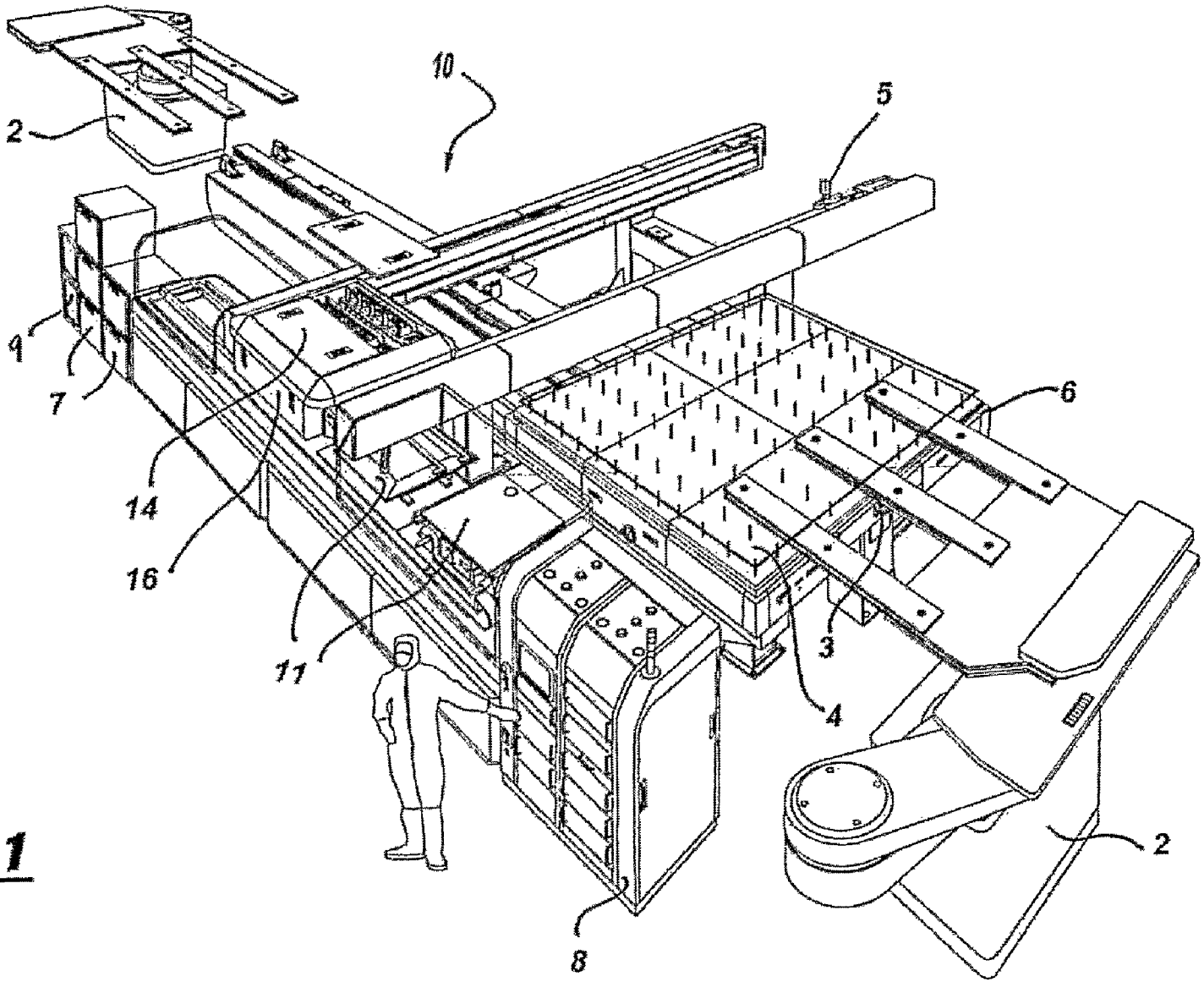
FIG. 1 is a perspective view of a piezoelectric microdeposition (PMD) apparatus including the integral printhead assembly of the present teachings.

The following description is merely exemplary in nature and is in no way intended to limit the teachings, its application, or uses.

The terms "fluid manufacturing material," "fluid material," and "printing fluid," as defined herein, are broadly construed to include any material that can assume a low viscosity form and that is suitable for being deposited, for example, from a PMD head onto a substrate for forming a microstructure. Fluid manufacturing materials may include, but are not limited to, light-emitting polymers (LEPs), which can be used to form polymer light-emitting diode display devices (PLEDs, and PolyLEDs). Fluid manufacturing materials may also include inks, plastics, metals, waxes, solders, solder pastes, biomedical products, acids, photoresists, solvents, adhesives, and epoxies. The term "fluid manufacturing material" is interchangeably referred to herein as "fluid material" or "printing fluid."

The term "deposition," as defined herein, generally refers to the process of depositing individual droplets of fluid materials on substrates. The terms 'let," "discharge," "pattern," and "deposit" are used interchangeably herein with specific reference to the deposition of the fluid material from a PMD head, for example. The terms "droplet" and "drop" are also used interchangeably.

The term "substrate," as defined herein, is broadly construed to include any material having a surface that is suitable for receiving a fluid material during a manufacturing process such as PMD. Substrates include, but are not limited to, glass plate, pipettes, silicon wafers, ceramic tiles, rigid and flexible plastic, and metal sheets and rolls. In certain embodiments, a deposited fluid material itself may form a substrate, in as much as the fluid material also includes surfaces suitable for receiving a fluid material during a manufacturing process, such as, for example, when forming three-dimensional microstructures.

The term "microstructures," as defined herein, generally refers to structures formed with a high degree of precision, and that are sized to fit on a substrate. In as much as the sizes of different substrates may vary, the term "microstructures" should not be construed to be limited to any particular size and can be used interchangeably with the term "structure." Microstructures may include a single droplet of a fluid material, any combination of droplets, or any structure formed by depositing the droplet(s) on a substrate, such as a two-dimensional layer, a three-dimensional architecture, and any other desired structure.

The PMD systems referenced herein perform processes by depositing fluid materials onto substrates according to user-defined computer-executable instructions. The term "computer-executable instructions," which is also referred to herein as "program modules or "modules," generally includes routines, programs, objects, components, data structures, or the like that implement particular abstract data types or perform particular tasks such as, but not limited to, executing computer numerical controls for implementing PMD processes. Program modules may be stored on any computer-readable media, including, but not limited to RAM, ROM, EEPROM, CD-ROM or other optical disk storage, magnetic disk storage or other magnetic storage devices, or any other medium capable of storing instructions or data structures and capable of being accessed by a general purpose or special purpose computer.

Referring to FIG. 1, there is shown a PMD apparatus 10 incorporating an integral printhead assembly 20. The PMD apparatus 10 includes a pair of robots 2 that load and unload a substrate 4 onto a substrate stage 6 of the PMD apparatus 10. The use of the robots 2 assists in maintaining the substrate 4 in a clean condition such that foreign materials do not obstruct or damage surfaces of the substrate 4 that will be deposited with the patterned inks. The PMD apparatus 10 also includes an optics system that includes a pair of cameras 3 and 5 that assist in assuring that the substrate 4 is aligned in the PMD apparatus 10 properly.

The PMD apparatus 10 includes a system control/power module 8 that controls operation of the PMD apparatus 10. In this regard, operating parameters such as ink patterns, discharge speed, etc. may be controlled by an operator. Further, the system control/power module 8 also controls an ink jet apparatus 14 and a droplet inspection module 16 of the PMD apparatus 10. The ink jet apparatus 14 includes a printhead array 12 of various integral printhead assemblies 20 that deposit the inks onto the substrate 4.

Inks that are deposited by the ink jet apparatus 14 are supplied by ink supply modules 7. The ink supply modules 7 allow various types of inks suitable for different applications to be stored simultaneously. Also included in the PMD apparatus 10 is a solvent cleaning module 9. The solvent cleaning module 9 supplies solvents used to clean the printheads of the ink jet apparatus 14 to a maintenance station 11 that cleans and assists in maintaining the printheads of the printhead array 12.

Figure 2:
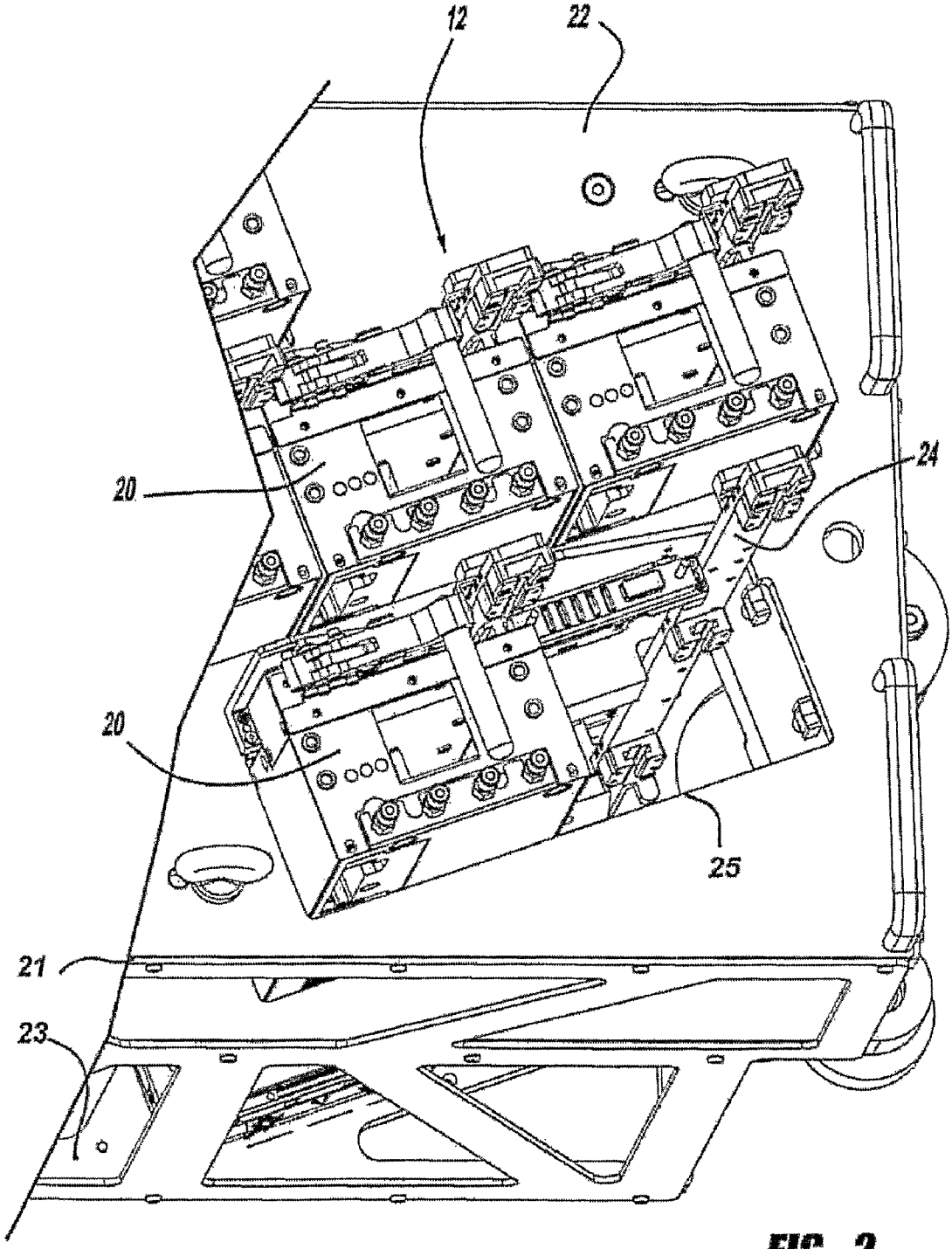
FIG. 2 is a top perspective view of a printhead array with the PMD apparatus of FIG. 1.
Figure 3A:
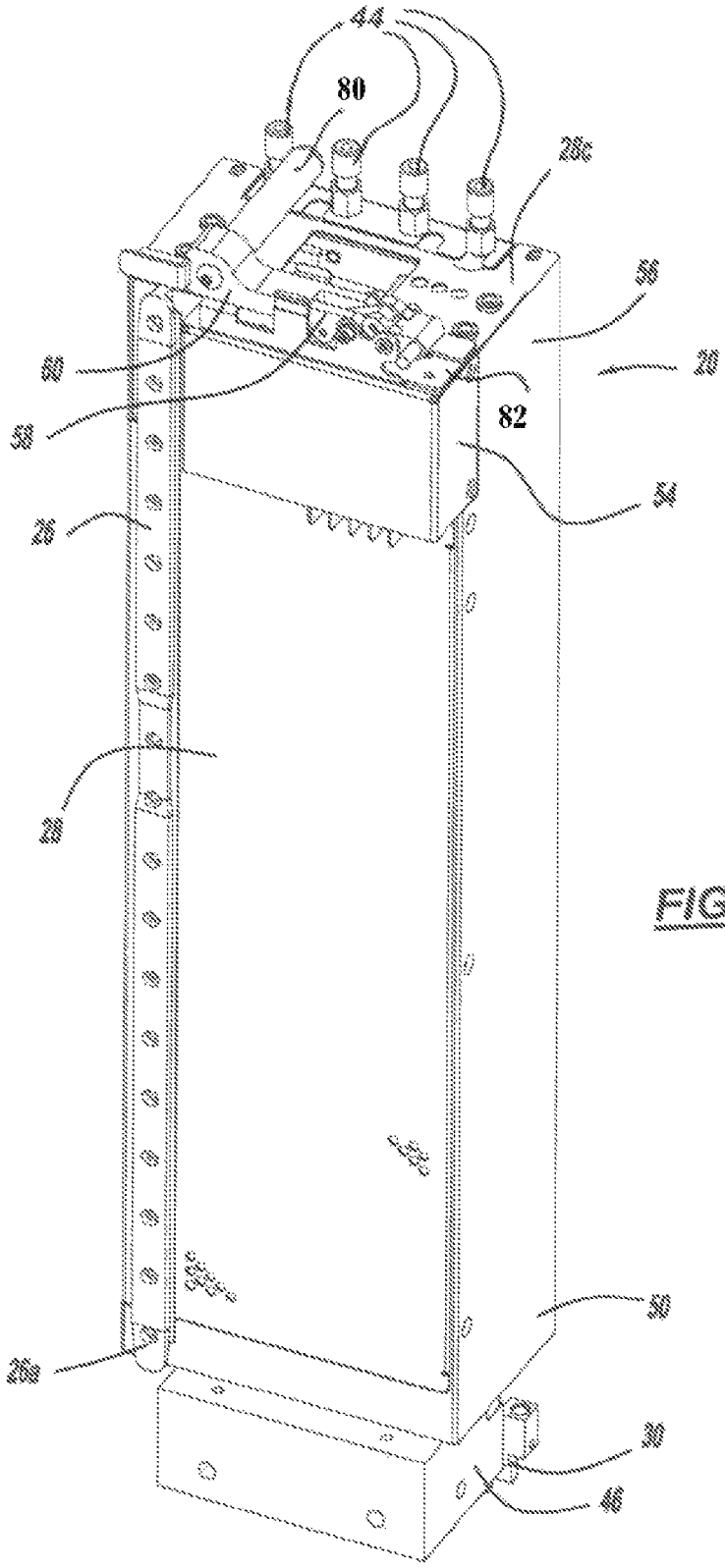
FIGS. 3A and 3B are assembled views of the integral printhead assembly of the present teachings removed from the PMD apparatus.

The printhead array 12, as shown more clearly in FIG. 2, generally includes a plurality of integral printhead assemblies 20. Each integral printhead assembly 20 is inserted into a printhead carriage 22 that is carried within ink jet apparatus 14. The carriage 22 includes an upper plate 21 and a lower plate 23. The upper plate 21 and lower plate 23 are provided with multiple corresponding docking ports 25 that receive each of the integral printhead assemblies 20. In each of these docking ports 25 is also disposed a guide rail assembly 24 that mates with a corresponding guide rail component 26 extending outwardly along a housing 28 of each of the integral printhead assemblies 20. As shown in FIG. 3A, the guide rail component 26 extends beyond the bottom of the printhead housing 28, thereby allowing a tip 26*a* of guide rail component 26 to serve as an alignment mechanism, which seats within an aperture (not shown) on the lower plate 23 of the printhead carriage 22.

Figure 3B:
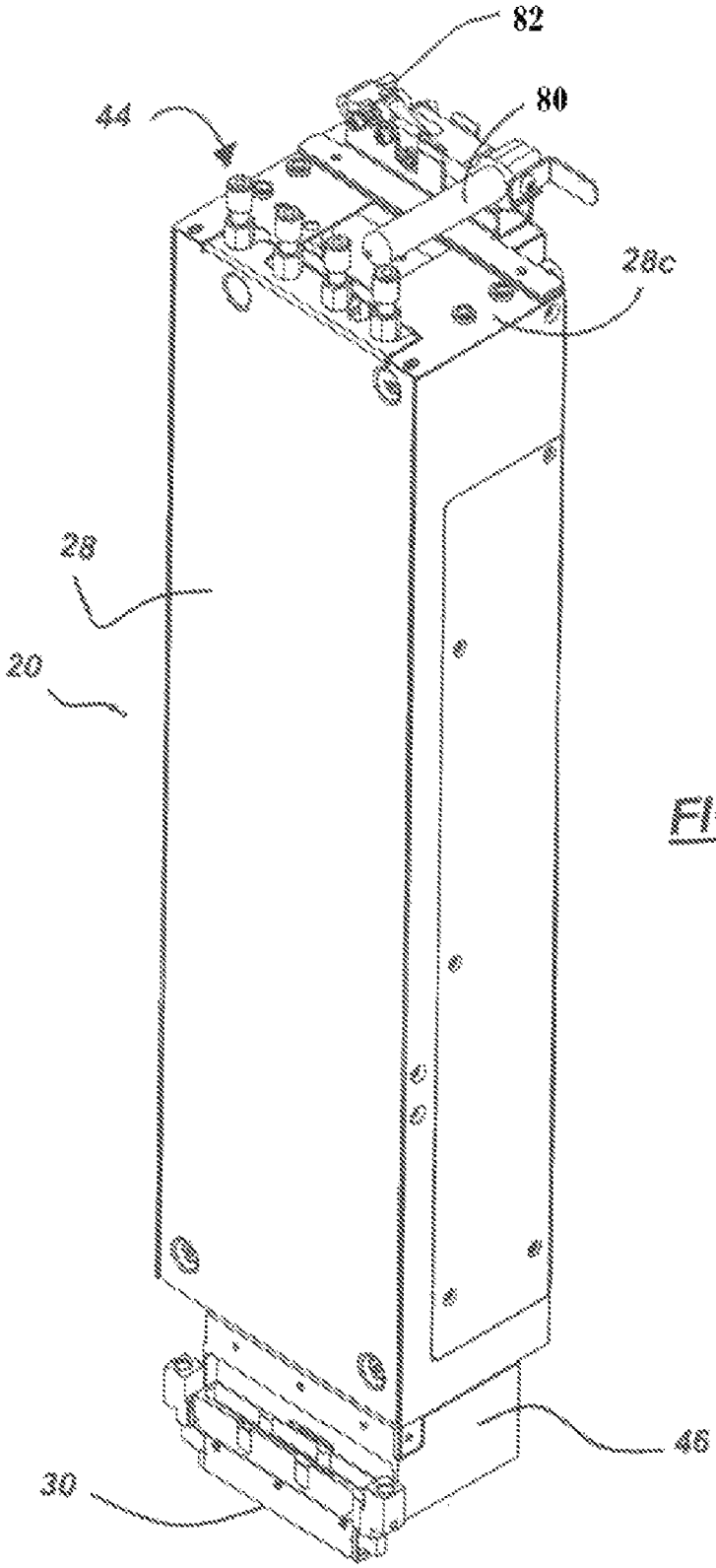
Figure 4:
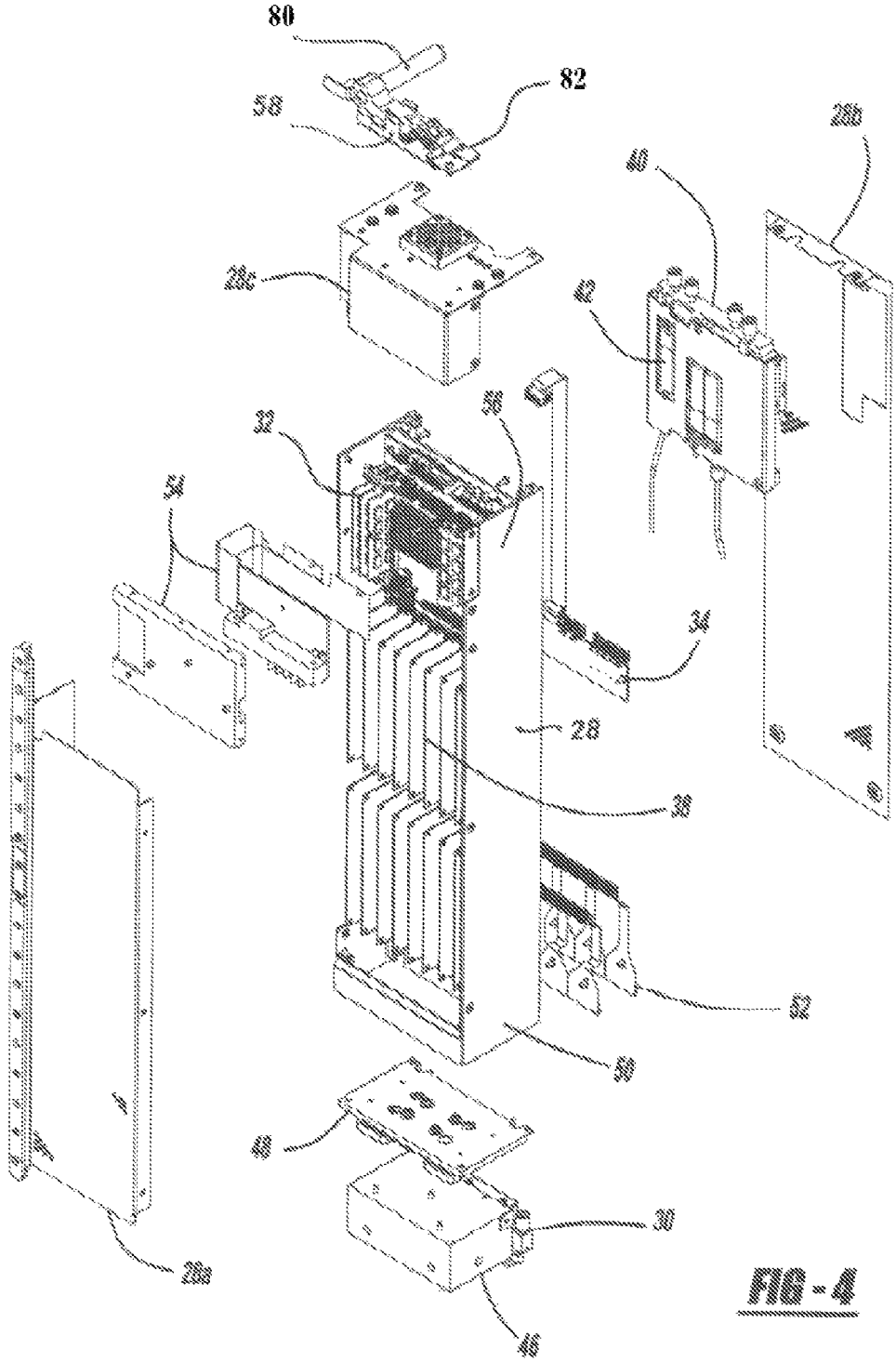
FIG. 4 is an exploded assembly view of the components of the integral printhead assembly of the present teachings.

The individual components of the integral printhead assemblies 20 are illustrated in FIGS. 3A, 3B, and 4. As shown in FIG. 4, the printhead assembly 20 includes a data board assembly 32 and an onboard PC-104 processor 34 for receiving and processing its portion of unprocessed print image information, which is captured via a drop analysis system such as that described in co-pending U.S. Application Ser. No. 60/674,589 entitled "Drop Analysis System," which is hereby incorporated by reference. The unprocessed image is much smaller in size compared to a post-processed file, which allows the unprocessed image to be sent to each of the printhead assemblies 20 via an appropriate connection, such as an Ethernet network by way of non-limiting example, very quickly. The onboard processors 104 then take over and create the print image.

The data board assembly 32 includes a non-volatile memory, and also includes a sufficient amount of onboard Dynamic Random Access Memory (DRAM) to assist in processing the image information, e.g., 1.5 GBytes. As the image is being processed, it is transferred to the onboard DRAM, where it is stored for printing at a later time. The image is then clocked out of DRAM for printing as many times as needed. Associated with the data board assembly are the drive electronics 38, which may include a multi-port fluid driver board by way of non-limiting example.

Figure 5:
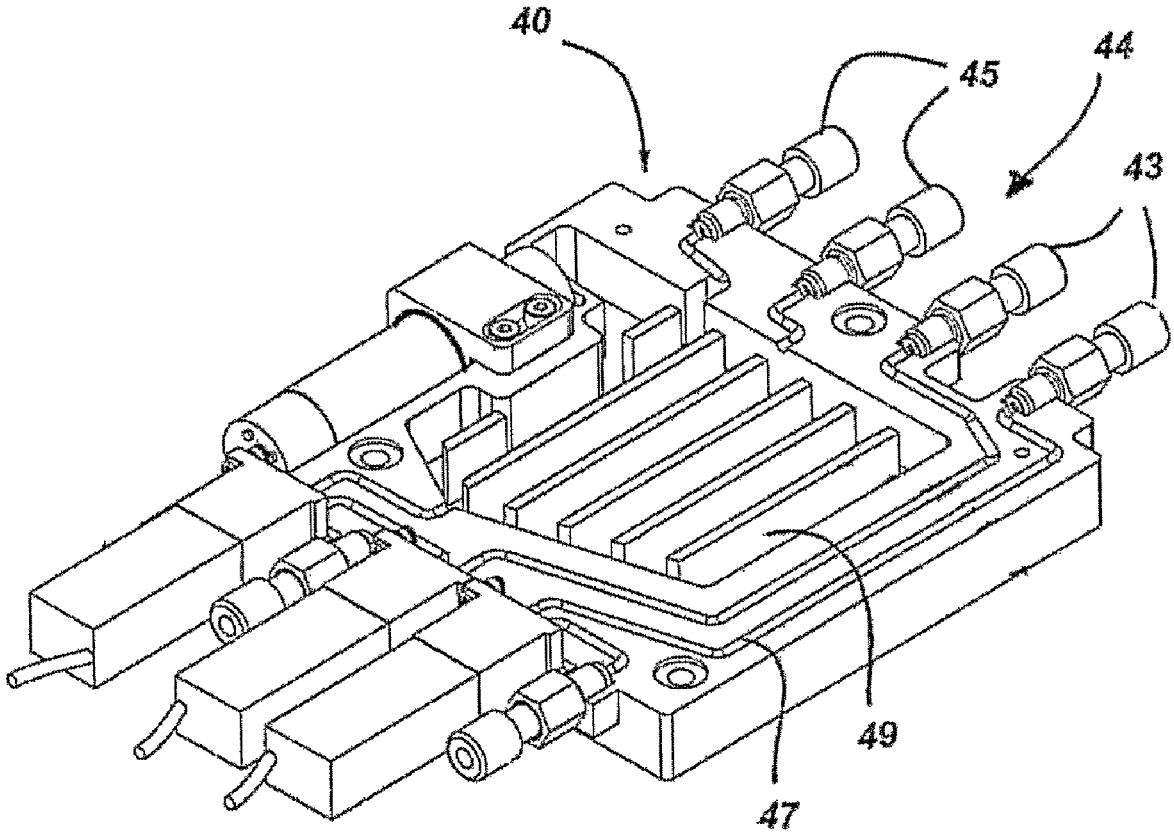
FIG. 5 is a perspective view of the printing fluid reservoir of the present teachings.

Referring to FIG. 5, the integral printhead assembly 20 also includes an onboard printing fluid reservoir 40 including separate channels or nozzles 44 for direct printing fluid delivery 43 and solvent flush waste fluid extraction 45. Separate fluid paths 47 and 49 within the reservoir 40 permit the printhead to be flushed with solvent without wasting the printing fluid that is contained within the mini-reservoir. The fluid in the reservoir 40 is pressurized by a vacuum line (not shown) which may be varied by settings carried by the non-volatile memory of the databoard assembly 32. In this manner, a meniscus of the fluid may be varied to control an amount of fluid sent to the printhead 30, which in turn controls a jetting of the nozzles of the printhead 30. That is, a meniscus pressure setting may be varied.

The printhead 30 may be cleaned out with solvent without introducing air into the printhead 30, which is important for getting all nozzles to jet consistently. Also, the waste fluid extraction feature allows for flowing fluid through the printhead manifold and reduces printhead bring-up time by quickly removing most of the air in the printhead. The reservoir 40 may include a fluid level sensor 42, which indicates when the printing fluid and/or solvent levels are low.

Each integral printhead assembly 20 includes a data board assembly 32, a processor 34 and drive electronics 38, as well as its own printing fluid reservoir 40. In this manner, each printhead assembly 20 is self-contained and separable from the rest of the printhead assemblies 20 because each printhead assembly 20 is capable of processing data independently. Should a printhead assembly 20 break down for any reason, the printhead assembly 20 can be removed from the printhead array 12 without disrupting the remaining printhead assemblies 20. Further, the use of integral printhead assemblies 20 allows an operator to store reserve printhead assemblies 20 that may be interchanged with malfunctioning or damaged printhead assemblies 20. These individually removable printhead assemblies 20 reduce machine downtime and increase productivity.

An off-line maintenance station may be used as a diagnostic tool to test each of the assemblies once the printhead assembly 20 has been removed and may assist in troubleshooting malfunctioning printhead assemblies 20. The off-line maintenance station may also be equipped with software for uploading data into the printhead assemblies 20. For example, the station may upload the ink patterns to be deposited into the printhead assembly 20 prior to the printhead assembly 20 being re-inserted into the printhead array 12.

By integrating the fluid reservoir 40 into the printhead assembly 20, ink may be replaced in the fluid reservoir 40 through the nozzles 44 quickly and efficiently without having to affect the other printhead assemblies 20. Regardless of whether a printhead assembly 20 is malfunctioning or requires ink replacement, the PMD apparatus 10 does not need to be powered down to remove individual printhead assemblies 20. In particular, when a problem arises in one of the printhead assemblies 20, such as, for example, an air bubble is present in a nozzle of the printhead or there is another discharge problem, a fatal warning will be sent to the system control/power module 8, which controls operation of the PMD apparatus 10, to alert an operator of the PMD apparatus 10. Subsequently, instead of powering down the PMD apparatus 10, the remaining printhead assemblies 20 are allowed to continue firing (i.e., discharging ink) at a lower frequency, such as about 10 Hz. Other low frequencies may be suitable. At a low frequency, a minimal amount of ink is discharged, but the continued firing prevents the nozzles of the other printhead assemblies 20 from clogging, which may prevent additional maintenance of the remaining printhead assemblies 20 while the malfunctioning printhead assembly 20 is removed and replaced.

Figure 6:
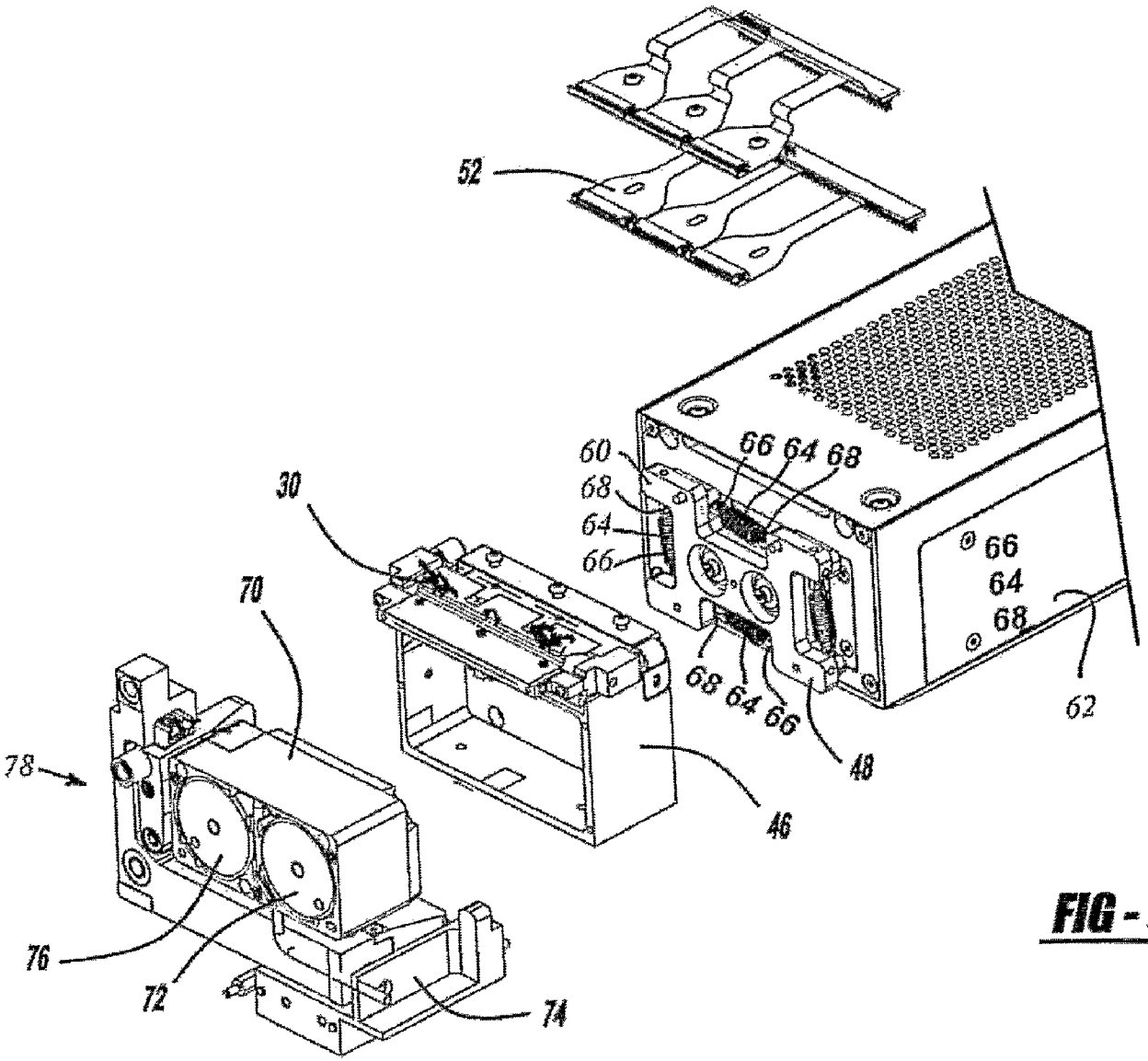
FIG. 6 is an exploded assembly view of the integral printhead assembly about to engage a dynamic printhead adjustment assembly.
Figure 7:
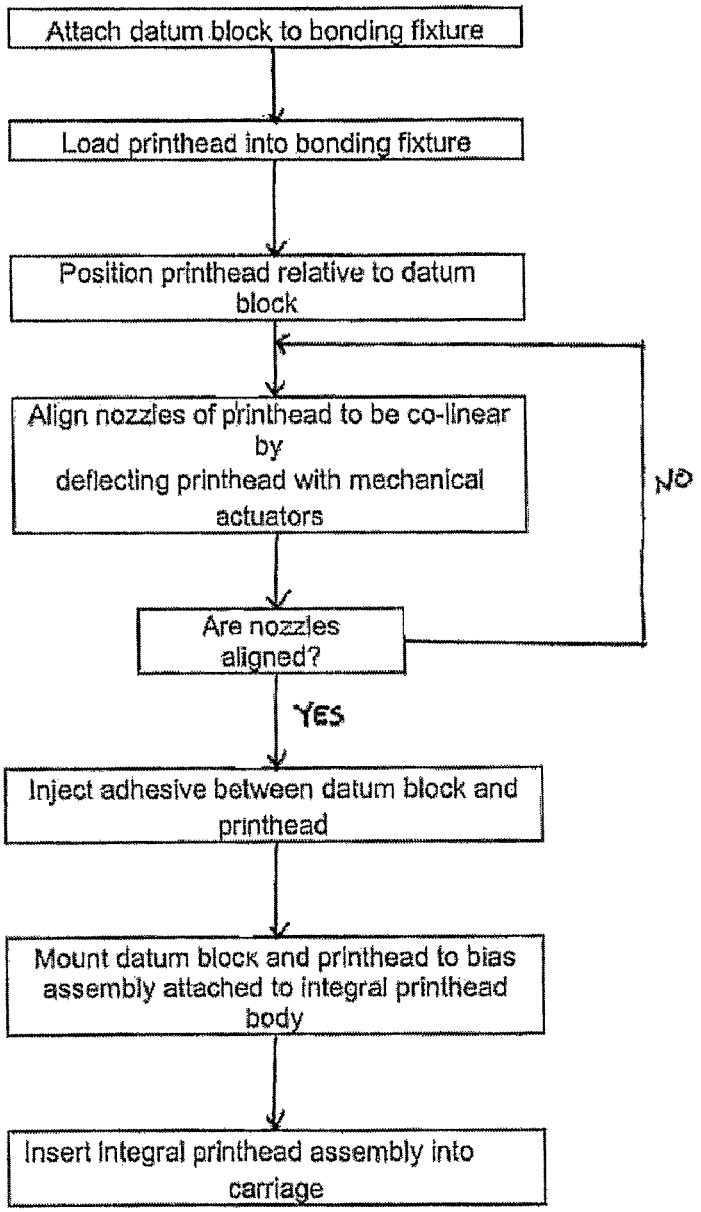
FIG. 7 is a flow chart setting forth steps used to connect a datum block and printhead to the integral printhead assembly of the present teachings.

Each printhead 30 is bonded to a precision ground datum block 46 such that the nozzles of the printhead 30 extend beyond the datum block 46 (FIG. 3B), thereby allowing an unobstructed view of the nozzles by the vision system described in co-pending U.S. Provisional Application Ser. No. 60/674,592 entitled "Dynamic Printhead Alignment Assembly," which is hereby incorporated by reference. Once the datum block 46 is attached to the bonding fixture 70, as shown in FIG. 6, applied forces cause intimate contact of the primary, secondary, and tertiary datum surfaces on the datum block 46. The printhead 30 is then loaded into the bonding fixture 70 and attached to movable links that position the printhead 30 relative to the datum block 46 and vision systems within the bonding fixture 70.

Next, optics in the fixture are adjusted for each printhead type to locate nozzles first and last, and a fixed camera locates a nozzle in the center of the printhead 30. The fixture 70, under software control, moves the printhead 30 to align with the camera focused on nozzle first and rotates the printhead so that nozzle last is co-linear to the first nozzle. Contemporaneously, the length of the printhead array is measured to assure compliance. The center of the printhead is then checked for alignment relative to nozzle first and last. If not, the center of the printhead is deflected via mechanical actuators in printhead adjust assembly 74 to bring it into alignment. In this manner, any bowing of the printhead can be corrected. This is important in that nozzles of printheads are rarely in alignment when manufactured due to manufacturing tolerances.

A fast curing adhesive is injected between the printhead 30 and the datum block 46 to lock it at this condition. After removal from the bonding fixture 70, additional potting compound is applied to prevent movement of the printhead 30 relative to the datum block 46 under temperature, humidity and shock conditions. After bonding the printhead 30 to the datum block 46, a fastener such as a screw or bolt can be used to further secure the printhead 30 to the datum block 46. An optical master is used in the bonding fixture 70 to establish the perfect bonded condition; this must not drift over time to assure interchangeability of integral printhead assemblies 20 as production spans many years.

The datum surfaces in the bonding fixture 70 are precisely duplicated in the PMD apparatus 10 for each printhead assembly 20 installed, thereby allowing for precise alignment of multiple assemblies. The bonding fixture 70 assures that the absolute "Z" position of the nozzle plate, the parallelism of the nozzle plate to the substrate, and the X and Y position of the nozzle array are capable of being aligned to sub-micron accuracy by the piezo adjuster in the PMD machine head array nest. This ensures that the nozzles are positioned +/−2 microns of true position from one to an unlimited number of printheads in a PMD machine.

The datum block 46 with the optically positioned and bonded printhead 30 is mounted to a spring-loaded bias assembly 48 that allows the datum block 46 to move in the X, Y direction and rotate about its vertical axis. This assembly 48 is connected to the printhead assembly housing 28 along a first end 50 using associated fixtures 52, which allows the datum block 46 to move in the Z direction and pitch and roll about its horizontal axis. The datum block 46 may float relative to the body of the integral printhead assembly 20.

As stated above, printhead 30 and datum block 46 may be isolated from the rest of the printhead assembly 20 by a spring-loaded bias assembly 48, which may include a mounting plate 60 coupled to integral printhead assembly body 62 by four springs 64. Each spring 64 may be a compression spring having first and second ends 66, 68. First end 66 of each spring 64 may be coupled to the body 62 of the integral printhead assembly 20, and second end 68 of each spring 64 may be coupled to mounting plate 60. As a result, mounting plate 60 may be generally movable relative to body 62 with approximately six degrees of freedom. Datum block 46 may be coupled to mounting plate 60, to form a printhead attachment block, giving datum block 46 the freedom to seat kinematically against datum surfaces and be adjusted relative thereto.

Upon insertion into the printhead carriage 22, this floating assembly is allowed to move and register against primary, secondary, and tertiary datum surfaces at the base of the carriage 22 as described in U.S. Provisional Patent Application Ser. No. 60/674,592 entitled "Dynamic Printhead Alignment Assembly," which is hereby incorporated by reference. The above described floating assembly is capable of achieving a repeatable +/−5 microns positional accuracy.

The printhead assemblies 20 do not require disconnection of electrical connections. Each integral printhead assembly 20 has a latching assembly 54, otherwise referred to herein as a blindmate connector, disposed along a second end 56 of the housing 28 and connected to a docking port 25 in the printhead array carriage 22 to provide a mechanical connection between the integral printhead assembly 20 and the printhead array 12. A movable handle 80 is attached to locking cam mechanism 58 on the top cover 28*c*. A microswitch 82 positioned at an end of the locking cam mechanism 58 senses when the handle 80 is moved. In the case of removal of the printhead assembly 20 and opening of the microswitch 82 contact, the power to the associated printhead assembly 20 is shut down and power is delivered to the bucking coils 76 surrounding the magnetic clamps 72 in the array nest 78, effectively canceling the force holding the printhead assembly 20 in the printhead array 12. Upon insertion, once the handle 80 is moved down to the latched position, the software is triggered to restore power to the integral electronics and the power to the bucking coils 76 is removed, allowing the magnetic clamps 72 to pull the datum block 46 to the primary datum (not shown) of the array nest 78. The cam mechanism 58 generates up to 40 pounds of force to ensure full connection of the blindmate electrical connector 54.

Once fully inserted into the printhead carriage 22, the integral printhead assembly 20 is held in place by magnetic clamp assembly 72, which in turn is part of a dynamic printhead adjustment assembly 74 as shown in FIG. 6 and described in the above noted Dynamic Printhead Adjustment Assembly application. The magnetic clamp assembly 72 may include a pair of magnets, wherein each magnet has a bucking coil 76 that, when energized, cancels the magnetic field and allows the integral printhead assembly 20 to be removed. The microswitch 82 on the handle 80 tells the system when to buck the magnet.

The present claimed invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. A printing apparatus comprising:

a stage operable to hold a substrate;

a plurality of printhead assemblies, each of which includes a housing and a datum block;

a carriage that receives said printhead assemblies;

for each of said printhead assemblies, a printhead connected to said datum block and operable to deposit printing fluid onto the substrate;

for each of said printhead assemblies, a kinematic connection between said housing and said datum block; and a positioning device that controls relative movement between said carriage and said stage, wherein each of said printhead assemblies further comprises a data board assembly including a computer for controlling fluid deposition from said printhead, wherein said computer calculates firing position based on drop velocity and travel speed.

2. The printing apparatus of claim 1 wherein each of said printhead assemblies further comprises a bond between said printhead and said datum block.

3. The printing apparatus of claim 2 wherein said bond includes a fast-curing adhesive.

4. The printing apparatus of claim 1 wherein said data board assembly includes at least approximately 1.5 Gigabytes of DRAM.

5. The printing apparatus of claim 1 wherein said data board assembly processes firing data for said printhead to correct for non-linear distortion of the substrate.

6. The printing apparatus of claim 1 wherein each of said printhead assemblies further comprises a fluid reservoir, wherein said data board assembly includes nonvolatile memory for storing parameters, said parameters including a meniscus pressure setting for said fluid reservoir.

7. The printing apparatus of claim 1 wherein each of said printhead assemblies further comprises a fluid reservoir that includes a plurality of fluid channels.

8. The printing apparatus of claim 7 wherein said plurality of fluid channels includes separate fluid delivery and solvent delivery channels, each selectively connected to said printhead.

9. The printing apparatus of claim 7 wherein said fluid reservoir is pressurized by a vacuum line, wherein pressure of said vacuum line can be varied to control a fluid meniscus.

10. The printing apparatus of claim 7 further comprising a plurality of fluid supply modules, wherein said fluid reservoir is in fluid communication with at least one of said plurality of fluid supply modules.

11. The printing apparatus of claim 1 further comprising a latching assembly for releasably connecting said housing to said carriage.

12. The printing apparatus of claim 11 wherein said latching assembly is activated by a movable handle.

13. The printing apparatus of claim 11 wherein said latching assembly comprises a locking cam mechanism that seats said housing against said carriage.

14. The printing apparatus of claim 11 wherein said latching assembly includes a microswitch that detects movement of a control member.

15. The printing apparatus of claim 14 wherein each of said printhead assemblies powers off when said microswitch detects movement of said control member.

16. The printing apparatus of claim 14 further comprising a clamping mechanism that retains one of said printhead assemblies relative to said carriage, wherein said clamping mechanism releases when said microswitch detects movement of said control member.

17. The printing apparatus of claim 16 wherein said clamping mechanism comprises a magnetic clamp.

18. The printing apparatus of claim 17 wherein said magnetic clamp includes permanent magnets and bucking coils, and said bucking coils energize when said microswitch detects movement of said control member.

19. The printing apparatus of claim 1 wherein said housing includes an external guide rail to attach said housing to said carriage.

20. The printing apparatus of claim 19 wherein said guide rail extends beyond a bottom side of one of said printhead assemblies to serve as an alignment mechanism.

21. The printing apparatus of claim 1 wherein said kinematic connection allows six degrees of freedom of movement.

22. The printing apparatus of claim 1 wherein said kinematic connection comprises a mounting plate and a plurality of springs.

23. The printing apparatus of claim 22 wherein said datum block is attached to said mounting plate.

24. The printing apparatus of claim 1 wherein each of said printhead assemblies further comprises a flexible circuit that provides an electrical connection between said housing and said printhead.

* * * * *